United States Patent [19]

Skardal

[11] 4,156,485

[45] May 29, 1979

[54] VORTEX CLEANER

[75] Inventor: Karl A. Skardal, Stocksund, Sweden

[73] Assignee: Cellwood Grubbens AB, Stockholm, Sweden

[21] Appl. No.: 860,105

[22] Filed: Dec. 13, 1977

[30] Foreign Application Priority Data

Jan. 5, 1977 [SE] Sweden ..... 7700105

[51] Int. Cl.[2] ..... B04C 5/16

[52] U.S. Cl. ..... 209/144; 209/211; 210/512 R; 55/459 R

[58] Field of Search ..... 209/211, 158, 144; 210/512 R, 84; 55/459; 138/39–40, 42–46

[56] References Cited

U.S. PATENT DOCUMENTS

| | | | |
|---|---|---|---|
| 2,976,994 | 3/1961 | Rodman et al. | 209/211 |
| 3,010,579 | 11/1961 | Duesling | 209/211 |
| 3,399,770 | 9/1968 | Salomon | 209/211 |
| 3,513,642 | 5/1970 | Cornett | 55/459 |

FOREIGN PATENT DOCUMENTS

| | | | |
|---|---|---|---|
| 2148422 | 3/1972 | Fed. Rep. of Germany | 209/211 |

*Primary Examiner*—Frank W. Lutter
*Assistant Examiner*—Jon E. Hokanson
*Attorney, Agent, or Firm*—Haseltine, Lake & Waters

[57] ABSTRACT

A vortex cleaner for separating a gaseous or liquid suspension, as for instance a paper pulp suspension, into fractions comprises an elongate vortex chamber which has a circular cross-section and tapers gradually, over at least part of its axial length, towards one axial end of the chamber. The larger end of the vortex chamber is provided with a tangential inlet for the suspension to be treated and an axial outlet for a lighter fraction of the treated suspension. The smaller end of the vortex chamber is provided with an axial outlet for a heavier fraction of the treated suspension. The tapering portion of the vortex chamber consists of a plurality of chamber sections, which are disposed one after the other in axial direction and are in direct communication with each other. Each such chamber section has a smaller diameter than the immediately preceding chamber section, as seen from the larger end of the vortex chamber, and has its center line displaced laterally relative to the center line of the immediately preceding chamber section, whereby a crescent-shaped ledge facing towards the larger end of the vortex chamber is formed at the transition from each chamber section to the immediately following chamber section. The chamber sections may be cylindrical or, preferably, truncated conical and divergent towards the smaller end of the vortex chamber.

8 Claims, 5 Drawing Figures

VORTEX CLEANER

This invention relates to a vortex cleaner, also called hydrocyclone, for separating a gaseous or liquid suspension into fractions and comprising an elongate vortex chamber, which has a circular cross-section and tapers gradually, at least over part of its axial length, towards one axial end of the chamber, the larger end of this vortex chamber being provided with a substantially tangential inlet for the suspension to be treated and a first, axial outlet for a lighter fraction of the treated suspension and the smaller end of the vortex chamber being provided with a second, axial outlet for a heavier fraction of the treated suspension.

Vortex cleaners of this type are used in large numbers in the paper and pulp industry for cleaning pulp suspensions, also called stock, from impurities as chips, shives, sand grains, metal particles and also larger metal objects as for instance paper clips, paper staples, needles, bolts, nuts etc., which latter impurities are often present in pulp suspensions prepared from waste paper. Vortex cleaners of this type are, however, also often used for treating other liquid suspensions as well as treating gaseous suspensions, in which the latter case the suspensions may be an airflow, from which liquid drops or solid particles carried by the airflow shall be removed as completely as possible, or an airflow used for transporting desired particles, as for instance wood chips of the type used for the manufacture of chipboard, but which may also carry larger and/or heavier impurities, as for instance stones, gravel particles, sand grains, metal particles and metal objects.

Irrespective of its use, a vortex cleaner of this type operates fundamentally in the following manner. The suspension to be treated, the so called inject, is fed into the vortex chamber at a high velocity through the tangential inlet at the larger end of the chamber. The suspension is fed into the chamber close to the inside of the wall of the chamber and the injected suspension will form a helical vortex flow, which moves along the inside of the wall of the vortex chamber towards the opposite, tapering end of the chamber. Under the influence of the centrifugal forces in this vortex flow the particles in the suspension tend to arrange themselves in such a manner that heavier and larger particles, as for instance impurities in the form of chips, shives, sand grains, metal particles, metal objects, etc. collect as close as possible towards the wall of the vortex chamber, whereas lighter particles in the suspension, for instance the usable fibres if a paper pulp suspension is being cleaned, remain closer to the centre axis of the vortex chamber. At the tapering end of the vortex chamber the layer of the vortex flow closest to the wall of the chamber, which layer contains the accumulated heavier impurities, shall continue to move towards the axial outlet at the smaller end of the vortex chamber so as to be discharged thorugh this outlet as a heavier fraction of impurities, the so called reject, whereas the inner portion of the vortex flow reverses adjacent the tapering end of the chamber and continues in the axially opposite direction as an inner helical vortex flow, which is discharged through the axial outlet at the larger end of the chamber as a lighter fraction, the so called accept. If the vortex cleaner is used for cleaning a paper pulp suspension, the accept will consist of usable fibres for its major part, whereas if the vortex cleaner is used for separating solid particles or liquid drops for an air or gas flow, the accept will consist only of air or gas.

In previously known vortex cleaners of this type the tapering portion of the vortex chamber is shaped as a truncated cone with a smooth inner wall. However, in these prior art vortex cleaners it has been found that the layer of larger and heavier impurities, which is accumulated close to the wall of the conically tapering part of the vortex chamber, will in many cases not manage to move all the way to the smaller end of the vortex chamber so as to discharge through the reject outlet in the intended manner. This results in an increasing accumulation of impurities in the conical tapering part of the vortex chamber, whereby the vortex cleaner may finally become completely clogged, in which case the operation of the cleaner must be interrupted so that the clogged reject outlet can be cleared. Even if such a complete clogging of the vortex cleaner does not arise, it often occurs that larger impurities of hard material present in the suspension, as for instance stones and metal objects, remain in the conically tapering portion of the vortex chamber for a considerable time, during which they are rotated continuously by the vortex flow in peripheral direction close to the conical wall of the vortex chamber substantially at the same place, which will in a short time give cause to very serious wear damages on the wall of the chamber.

The reason for the above phenomenon in prior art vortex cleaners seems to be that the conical wall of the vortex chamber exerts a reaction force on the suspension layer closest to the wall, which reaction force is substantially perpendicular to the wall and as a consequence has an axial component directed towards the larger end of the vortex chamber. This axial force component will counteract and may balance the force produced by the inject feed pressure, which strives to move the vortex flow towards the smaller end of the vortex chamber. It will be appreciated that it is the radial contraction of the vortex flow, caused by the conical tapering portion of the vortex chamber, which causes the portion of the vortex flow closest to the center axis of the vortex chamber to reverse and move in the axial opposite direction towards the accept outlet at the larger end of the chamber. If, however, the two above-mentioned forces acting upon the suspension layer closest to the conical wall of the vortex chamber happen to balance each other, it is realized that the impurities concentrated to this suspension layer will find it very difficult to move in the intended manner towards the reject outlet at the smaller end of the vortex chamber.

The object of the present invention is therefore to provide a vortex cleaner of the type described in the foregoing, in which the tapering portion of the vortex chamber is of such design that the problem discussed above is eliminated or at least reduced substantially.

According to the invention this object is achieved in that the tapering portion of the vortex chamber comprises a plurality of chamber sections located one after the other in the axial direction and being in direct communication with each other, each such chamber section having a circular cross-section with a smaller diameter than the immediately preceding chamber section, as seen from the larger end of the vortex chamber, and having its center line displaced laterally relative to the center of said preceding chamber section to such an extent that a crescent-shaped ledge facing towards the larger end of the vortex chamber is formed at the transition from one chamber section to the axially following chamber section.

Each chamber section may be cylindrical, i.e. have a wall parallel to the axis of the vortex chamber, or according to a preferred embodiment of the invention each chamber section may be shaped as a truncated cone divergent towards the smaller end of the vortex chamber.

In a vortex cleaner according to the invention the tapering portion of the vortex chamber does not comprise any conical wall surfaces which can exert a reaction force on the suspension layer closest to the wall having an axial component of force directed towards the layer end of the vortex chamber. On the contrary, there exists at each point within the tapering portion of the vortex chamber a portion along the circumference, within which portion the force produced by the inject feed pressure can act without any hindrance whatsoever upon the suspension layer closest to the wall and force this suspension layer, to which the impurities have been concentrated, to move towards the reject outlet at the smaller end of the vortex chamber.

The invention and additional characteristical features thereof will be described in greater detail in the following with reference being made to the accompanying drawings, which show some embodiments of the invention by way of example.

Figure 1:
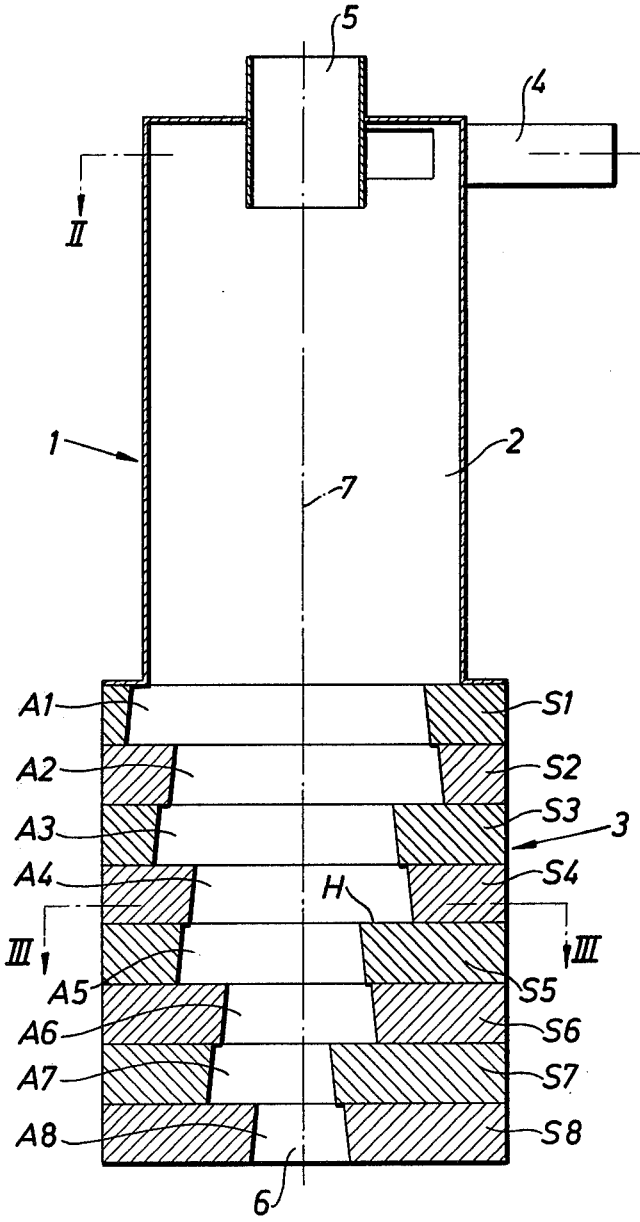
FIG. 1 shows schematically and in axial section a vortex cleaner according to the invention.
Figure 2:
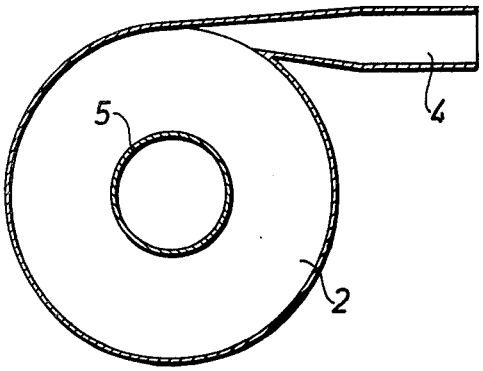
FIG. 2 shows schematically a cross-section through the vortex cleaner along the line II—II in FIG. 1.
Figure 3:
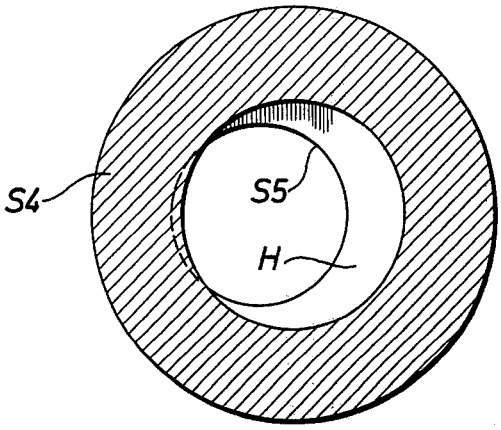
FIG. 3 shows schematically a cross-section through the vortex cleaner along the line III—III in FIG. 1.

The vortex cleaner according to the invention shown schematically and by way of example in FIGS. 1 to 3 comprises in conventional manner an elongate vortex chamber, which is generally designated with 1 and which comprises a circular cylindrical portion 2 and a portion generally designated with 3, which tapers towards one axial end of the vortex chamber. In prior art vortex cleaners of this type said tapering portion of the vortex chamber is shaped as a truncated cone, but in the vortex cleaner according to the present invention this tapering portion of the vortex chamber is of a different design, as will be described in the following. At its larger end the vortex chamber 1 is provided with a tangential inlet 4 for the suspension to be treated and also with an axial accept outlet 5, disposed centrally relative to the axis 7 of the vortex chamber, for a lighter fraction of the treated suspension. At its smaller end the vortex chamber is provided with a similar, axial reject outlet 6 for a heavier fraction of the treated suspension. This reject outlet 6 can in conventional manner be connected to a suitable, conventional reject discharge device (not shown in the drawing) for controlling the volume of the reject flow.

When a suspension is injected with high velocity through the inject inlet 2 in tangential direction close to the inside of the wall of the vortex chamber 1, the suspension will form a helical vortex flow which moves towards the tapering end of the chamber. Under the influence of the centrifugal forces in this vortex flow the particles in the suspension strive to arrange themselves in such a way that heavier particles are concentrated to a layer close to the inside of the wall, which layer will be moved by the vortex flow towards the smaller end of the vortex chamber to be discharged through the reject outlet 6. Due to the tapering form of the vortex chamber, the major portion of the vortex flow will reverse its direction within this tapering portion of the vortex chamber and continue in the opposite direction towards the larger end of the vortex chamber as an inner helical vortex flow. This inner vortex flow, which in the ideal case shall be substantially free from larger and heavier particles, i.e. from impurities, is discharged through the axial accept outlet 5 at the larger end of the chamber.

In a conventional vortex cleaner of this type, in which the tapering portion of the vortex chamber is shaped as a truncated cone, it can occur, as mentioned in the foregoing, that the suspension layer closest to the wall of the vortex chamber, in which layer the heavier and larger particles have accumulated, does not manage to move along the conical wall all the way to the reject outlet 6, but will instead to a substantial extent remain within the conical portion of the vortex chamber. In the vortex cleaner according to the invention this serious deficiency is eliminated due to a novel and specific design of the tapering portion 3 of the vortex chamber.

In the embodiment of the invention illustrated in FIGS. 1 to 3, the tapering portion 3 of the vortex chamber 1 consists of a plurality of chamber sections A1 to A8, which follow one after the other in axial direction and are in direct communication with each other. In the illustrated embodiment these chamber sections A1 to A8 are formed by circular openings or apertures in corresponding planar discs S1 to S8, which are stacked one upon another perpendicular to the center axis 7 of the vortex chamber. In the illustrated embodiment of the invention the openings in the discs S1 to S8, which form the chamber sections A1 to A8, are truncated conical so as to be somewhat divergent towards the reject outlet 6. However, said openings and thus the chamber sections A1 to A8 could also be completely circular cylindrical.

As can be seen in FIGS. 1 and 3, which show the disc S4 for the chamber section A4 in section and the subjacent disc S5 for the following chamber section A5 in plan view, each chamber section A1 to A8 has a smaller diameter than the immediately preceding chamber section and, further, the chamber sections A1 to A8 are displaced laterally alternatingly in two opposite directions relative to the center axis 7 of the vortex chamber so that each chamber section is located eccentrically relative to the immediately preceding chamber section as well as the immediately following chamber section.

It will be appreciated that within each chamber section A1 to A8 nothing can prevent or counteract a movement towards the reject outlet 6 for the suspension layer closest to the wall, which layer contains the heavier and larger particles in the suspension. On the contrary, in the illustrated embodiment of the invention such motion is supported in that each chamber section is somewhat divergent towards the reject outlet 6. At the transition between two adjacent chamber sections, as for instance the chamber sections A4 and A5 in the discs S4 and S5, respectively, there is certainly a ledge H which is perpendicular to the axis 7 of the vortex chamber. However, due to the mutual eccentrical positions of these two chamber sections, said ledge H is crescent-shaped and does not extend all the way around the circumference. This ledge H acts, of course, as an obstacle for the movement of the suspension layer closest to the chamber wall towards the reject outlet 6, but as the ledge is very narrow at its two ends and does not extend all the way around the circumference and as the suspension has a continuous rotation about the center axis 7 of the vortex chamber, it will be appreciated that also the suspension layer closest to the wall of the vortex chamber will without hindrance be discharged into the following chamber section, when the suspension during its rotational flow reaches the segment of the circumference, where the ledge H is missing. As a consequence, there is an extremely small risk that impurity particles shall remain for any extending period in a rotational movement above the ledge H so as to give cause to wear damages on the wall of the vortex chamber or to a clogging of the cleaner. It will be appreciated that this course of events will take place at each transition from one chamber section A1–A7 to the immediately following chamber section.

The number of chamber sections, their axial lengths, i.e. the thickness of the discs S1 to S8, as well as the diameter difference between two adjacent chamber sections are parameters determined by the size of the vortex cleaner and the desired tapering of the vortex chamber. By experiments these parameters can be given their optimum values in each practical case. The chamber sections provide a peripheral length in such a way that the crescent-shaped ledge at the transition between the two chamber sections corresponds to 360°. Preferably this ledge has a peripheral length corresponding to an angle smaller than 360°. As a border line case the peripheral length of the ledge can be increased to correspond to an angle of almost 360°, i.e. the lateral relative displacement of two adjacent chamber sections is substantially equal to the difference between the radii of the chamber sections.

In the embodiment of the invention described above the subsequent chamber sections A1 to A8 are laterally displaced alternatingly in two opposite directions relative to the center axis 7 of the vortex chamber. However, this is in no way a requisite for the invention, but different chamber sections may also be laterally displaced relative each other in several different directions. However, the structure is perferably substantially symmetrical relative to the center axis 7 of the vortex chamber.

As mentioned in the foregoing, the crescent-shaped ledge at the transition from one chamber section to the following chamber section will to a certain extent form an obstacle to the movement of the suspension layer closest to the chamber wall towards the reject outlet 6. According to a further development of the invention, illustrated in FIGS. 4 and 5, this disadvantage can be reduced substantially.

Figure 4:
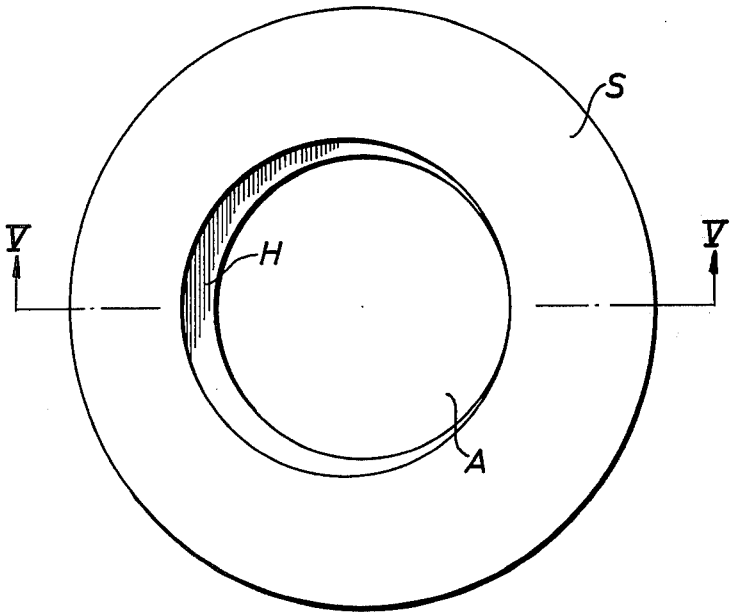
FIG. 4 is an end view of another embodiment of the discs forming the tapering portion of the vortex cleaner.
Figure 5:
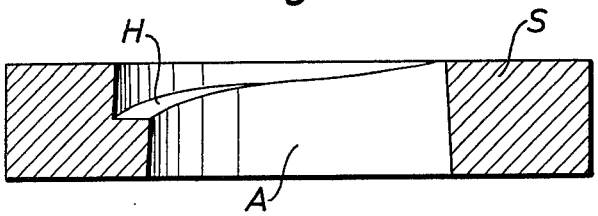
FIG. 5 is an axial section through the disc in FIG. 4 along the line V—V in FIG. 4.

FIGS. 4 and 5 show an end view and an axial section, respectively, of a disc S corresponding to anyone of the discs S1 to S8 in FIG. 1 and consequently provided with a circular cylindrical or truncated conical opening forming a chamber section A in the tapering portion of the vortex chamber. The crescent-shaped portion along the inner edge of this disc S, which will form an exposed ledge H relative to the immediately preceding chamber section, is in this case sloping continuously and helically in the direction of rotation of the vortex flow from the upper side of the disc S, i.e. the side facing the larger end of the vortex chamber, to the lower side of the disc, i.e. the side facing the smaller end of the vortex chamber. In this way it is achieved that this ledge H will no longer prevent or counteract the movement of the suspension layer closest to the chamber wall towards the reject outlet 6, but will instead rather promote this movement. If the crescent-shaped ledge H is sloping in this manner, its peripheral length can without any disadvantage be increased, for instance to correspond to an angle of almost 360°.

In the embodiments of a vortex cleaner according to the invention which have been described above by way of example, the tapering portion of the vortex chamber is constructed of a number of planar, stacked discs corresponding to the number of subsequent chamber sections. Such a design of the tapering portion of the vortex chamber is preferable with respect to the manufacturing process, as each such disc has a very simple form and is easy to manufacture. It will be appreciated, however, that the tapering portion of the vortex chamber may also be made in one piece by use of a casting technique suitable for the material used in the wall of the vortex chamber.

I claim:

1. A vortex cleaner for separating a gaseous or liquid suspension into fractions, comprising an elongate vortex chamber having a circular cross-section and tapering, at least over part of its axial length, towards one axial end of the chamber, the larger end of said vortex chamber being provided with a substantially tangential inlet for the suspension to be treated and a first, axial outlet for a lighter fraction of the treated suspension and the smaller end of said vortex chamber being provided with a second, axial outlet for a heavier fraction of the treated suspension, the tapering portion of said vortex chamber comprising a plurality of chamber sections disposed one after the other in the axial direction of the vortex chamber and being in direct communication with each other, each of said chamber sections having a smaller diameter than the immediately preceding chamber section, as seen from the larger end of the vortex chamber, and having its center line displaced laterally relative to the center line of said immediately preceding chamber section to such an extent that a crescent-shaped ledge facing towards the larger end of the vortex chamber formed at the transistion from one chamber section to the immediately following chamber section.

2. A vortex cleaner as claimed in claim 1, wherein said chamber sections are cylindrical.

3. A vortex cleaner as claimed in claim 1, wherein said chamber sections are truncated conical and divergent towards the smaller end of the vortex chamber.

4. A vortex cleaner as claimed in claim 1, wherein each of said crescent-shaped ledges slope continuously and helically in the direction of a suspension flow fed into the vortex chamber through said tangential inlet, from the axial end of the associated chamber section closest to the larger end of the vortex chamber towards the axial end of said chamber section closest to the smaller end of the vortex chamber.

5. A vortex cleaner as claimed in claim 1, wherein said chamber sections provide a peripheral length of said crescent-shaped ledge corresponding to an angle smaller than 360°.

6. A vortex cleaner as claimed in claim 1, wherein said mutual lateral displacement between the center lines of two adjacent chamber sections are substantially equal to one half of the difference between the diameters of said chamber sections as measured at the transition between them, whereby said crescent-shaped ledge has a peripheral length substantially corresponding to an angle of 360°.

7. A vortex cleaner as claimed in claim 1, wherein said chamber sections are laterally displaced alternatingly in two opposite directions relative to the axis of the vortex chamber.

8. A vortex cleaner as claimed in claim 1, wherein said chamber sections are formed by openings in a corresponding number of planar discs stacked on each other perpendicular to the axis of the vortex chamber.

* * * * *